United States Patent [19]

Pracchia

[11] 4,155,584

[45] May 22, 1979

[54] AUTOMATIC LOCKING MECHANISM FOR REFUSE CONTAINER

[76] Inventor: Pietro G. Pracchia, 167 Edith St., Petaluma, Calif. 94952

[21] Appl. No.: 784,580

[22] Filed: Apr. 4, 1977

[51] Int. Cl.[2] ..... B65F 1/12

[52] U.S. Cl. ..... 294/73; 414/407; 414/414

[58] Field of Search ..... 294/73, 69; 214/302, 214/307, 313, 314; 292/341.15, 341.17; 220/260

[56] References Cited

U.S. PATENT DOCUMENTS

| | | | |
|---|---|---|---|
| 3,136,437 | 6/1964 | Shimmon | 214/307 |
| 3,662,910 | 5/1972 | Herpich et al. | 214/302 |
| 3,759,561 | 9/1973 | Barnes et al. | 214/302 |

*Primary Examiner*—James B. Marbert
*Attorney, Agent, or Firm*—Flehr, Hohbach, Test, Albritton & Herbert

[57] ABSTRACT

A refuse container incorporating a security locking mechanism disposed completely within the container and which is actuated only when the container is turned over. In one embodiment a weight is mounted to pivot by gravity through a circular path when the unit is tilted. A hammer carried by the weight strikes an anvil on a crank arm which operates through a toggle connecting link to pivot a locking lever. A detent on the locking lever is moved out of engagement with a perimeter frame which is pivotally mounted on the open end of the container. A closure lid which is independently locked to the frame swings open with the frame for discharging the contents. In another embodiment a weight is moved by gravity through an arc to strike and pivot a detent arm which normally retains a larger second weight. The second weight then moves by gravity along a linear path towards the end of a tube where it strikes and pivots a locking lever. The lever then moves a detent out of engagement with a perimeter frame which thereby is free to swing open with the closure lid for dumping the contents.

12 Claims, 5 Drawing Figures

AUTOMATIC LOCKING MECHANISM FOR REFUSE CONTAINER

BACKGROUND OF THE INVENTION

This invention relates in general to refuse containers, and in particular relates to refuse containers of the type which are lifted and turned over by boom arms for dumping.

Containers of the type described are commonly used for collecting garbage and other refuse, which is then emptied periodically by a dump truck. Boom arms which extend forwardly of the truck engage and lift the container over the cab to dump the refuse into the truck body.

In many cases it is desirable to provide a locked closure on the refuse container, particularly to discourage vandalism. There have been many instances in which vandals have set fires in open refuse containers with resulting serious damage to life and property. However, where containers are locked in this manner it is necessary for the driver of the dump truck to carry different keys for the various locks along his route, and it is also necessary for him to leave the cab of the truck for unlocking and relocking such a container.

A number of different refuse container locking devices have previously been provided. Among these devices are those which are actuated responsive to movement of the tines on the dump truck. However, these devices are not completely satisfactory because they can be easily unlocked by unauthorized persons and thus are not secure.

It would be desirable to provide a refuse container which could be independently locked by the user to prevent unauthorized entry and deter vandalism. Liability exposure and insurance rates could thereby be reduced. It is further desirable to provide a container locking system which could be automatically unlocked during the dumping operation without the necessity of the driver leaving his cab, but which at the same time incorporates a locking mechanism which is wholly internal of the container so that it is not subject to tampering.

OBJECTS AND SUMMARY OF THE INVENTION

It is the general object of the invention to provide a refuse container incorporating a new and improved security locking mechanism.

Another object is to provide a refuse container of the type described in which the mechanism is unlocked responsive to dumping action without intervention of the operator, but which permits a user to independently lock and unlock the closure lid for filling the container.

Another object is to provide a locking mechanism which is wholly internal of a refuse container where it is not subject to outside tampering.

Another object is to provide a refuse container and locking mechanism of the type described in which a closure lid is independently lockable on a closure frame which in turn is locked to the container by a mechanism which is operated by gravity responsive to change in position of the container.

The invention in summary includes a refuse container having an interior-mounted locking mechanism for releasably securing a closure frame and lid. In one embodiment the mechanism includes a weight which is mounted to pivot through an arc as the container is turned over. A hammer carried by the weight strikes a crank arm which operates through a toggle connecting link and locking lever to release a detent from the closure frame so that the lid can swing open. In another embodiment the mechanism includes a first weight which swings by gravity through an arc to strike and pivot a detent arm out of engagement with a second weight. The second weight then moves by gravity along the length of a tube to strike and pivot a locking lever which moves a detent out of engagement with the closure frame.

The foregoing and additional objects and features of the invention will appear from the following description in which the several embodiments have been set forth in detail in conjunction with the accompanying drawings.

DESCRIPTION OF THE PREFERRED EMBODIMENTS

Figure 1:
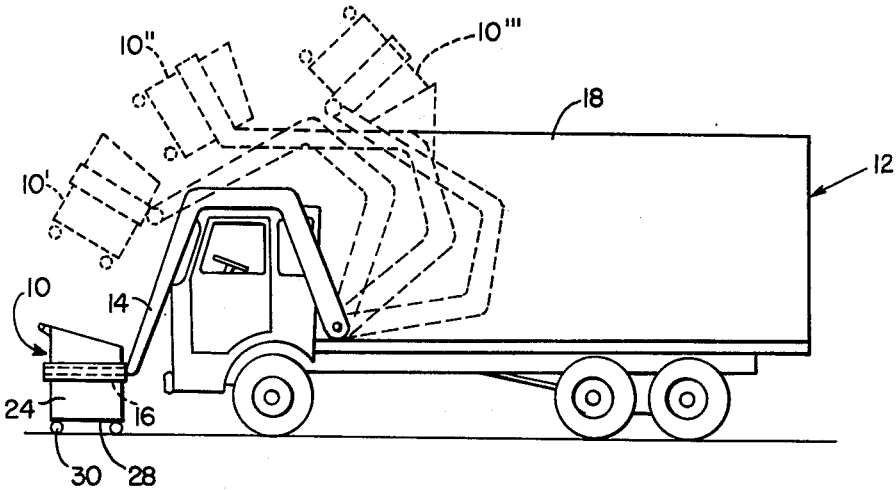
FIG. 1 is a side elevation view of a refuse container of the invention shown in use with a dump truck.
Figure 2:
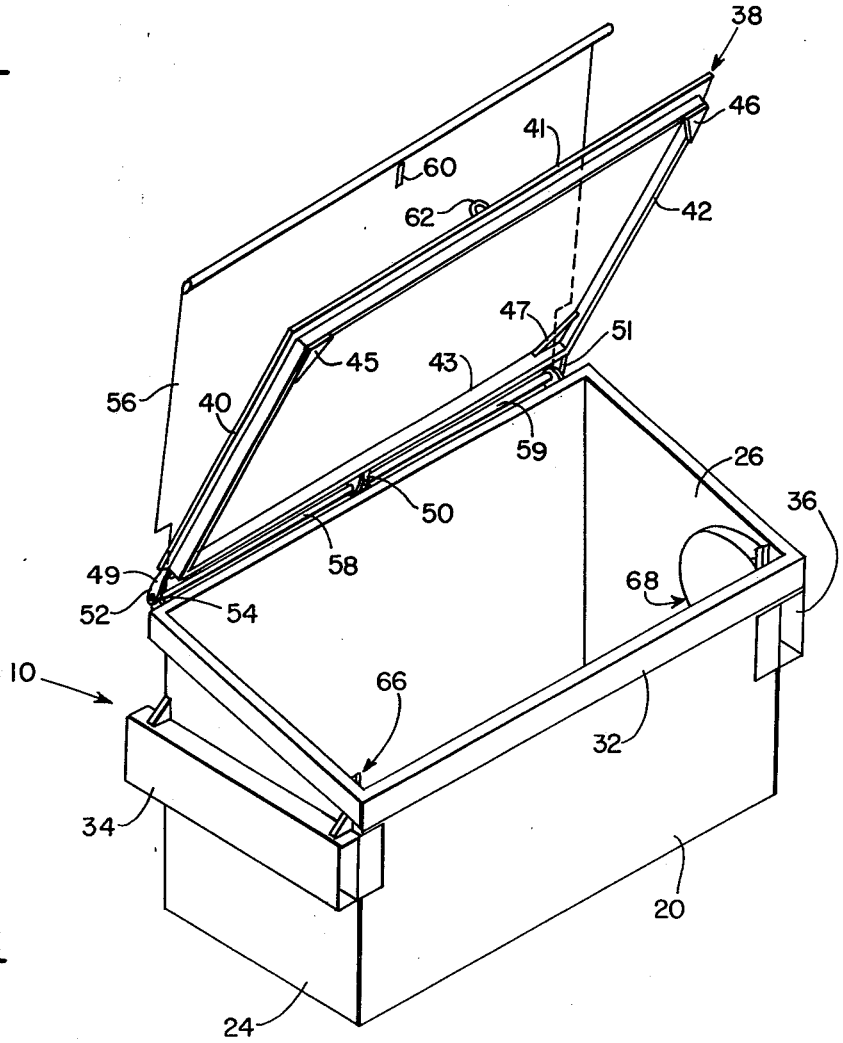
FIG. 2 is a perspective view of the container shown in FIG. 1.

In the drawings FIG. 1 illustrates generally at 10 a refuse container according to the invention shown in use with a typical refuse collection and dump truck 12. Dump truck 12 incorporates a pair of boom arms 14 pivotally mounted on either side and which include forwardly projecting tines 16 for engagement with the container. Suitable hydraulic actuators, not shown, are provided to pivot the booms to raise and lower the container over the cab through the serial positions 10'-10" for dumping refuse into the open bin 18. Hydraulic actuators, now shown, may be provided for pivoting the tines up and down through an arc relative to the ends of the boom arms.

Container 10 is generally box-shaped and includes front and rear walls 20, 22 and a pair of sidewalls 24, 26 which extend upwardly from a bottom wall 28. Wheels 30 may be mounted on the bottom wall. Rear wall 22 is of greater height than the front wall so that the open top slopes forwardly and downwardly. A reinforcing rim 32 is constructed about the perimeter of the open top. A pair of box-shaped tine pockets 34, 36 are mounted on the outer sides of the two sidewalls, and the ends of the pockets are open for receiving the tines 16.

A rectangular perimeter closure frame 38 is provided and includes four angles 40–43 secured together at their ends by means such as welding. Triangular braces 45–47 are welded in the corners for reinforcing the frame. The downwardly projecting sides of the angles are sized to fit within rim 32 of the container. Three spaced brackets 49–51 project from the rear angle to mount the frame for pivotal movement about an elongate hinge pin 52 mounted through openings formed in three lugs 54 which are welded to the rear side of the rim.

A flat closure lid 56 is sized to cover frame 38. A pair of tubes 58, 59 are mounted across the lower end of the lid and the hinge pin is inserted through the tubes so that the lid pivots to and from the container about the same axis as that of the closure frame. A slot 60 formed in the outer margin of the lid closes about a staple 62 mounted above the outer angle of the frame so that a padlock 64 (FIG. 3) can be mounted through the staple for independently locking the lid on the frame.

A pair of locking mechanisms 66, 68 are mounted within the container on the inner surfaces of the sidewalls 24, 26. Locking mechanism 66 is typical of the two and includes a housing 70 which protects the operating parts from the refuse. Within the housing a weight 72 is carried on an arm 74 which is pivotally mounted on a transverse shaft 76 so that the weight moves through a circular path or arc. The axis of shaft 76 is generally parallel with the axis about which the container is turned as it is dumped. A hammer 78 is mounted intermediate the arm. A crank arm 80 is also pivotally mounted on the shaft and is formed with an anvil portion 82 which is positioned in the path of movement of the hammer. Anvil 82 of the crank arm is oriented so that the hammer and weight travel through a substantial arc, illustrated as 65°, to build up substantial momentum to deliver a strong impact force at the time of contact with the anvil.

A limit stop 84 is mounted within the housing to hold weight 72 at an initial or home position when the container is supported upright and the mechanism is locked. A second limit stop 86 is mounted at a suitable position, e.g. 135° of arc from stop 84, to hold the weight in the rest position 72' after the container has been tipped and the mechanism unlocked. The orientation of home position stop 84 is such that the weight is carried past the 12 o'clock position for gravity to assume command and begin to pivot the weight just after the container has been turned about its lateral axis and is over the truck bin approaching position 10'' of FIG. 1. The orientation of rest position stop 86 is such that following return of the container to the upright position further counter-clockwise tipping through operation of the boom and tine actuators causes the weight to move across the 12 o'clock position and return by gravity to its home position.

A connecting link 88 is pivotally mounted at one end through pin 82 on an end of crank arm 80. The other end of the link is formed with a slot 90 which is mounted in a lost-motion connection about a pin 92 carried on the end of a locking lever 94. The locking lever is pivotally mounted on a shaft 96. The opposite end of the locking lever projects upwardly through an opening 98 formed in the housing and the end carries an inclined detent plate 100. The inner edge of the detent plate engages a lip on corner bracket 45 of the perimeter frame 38. A tension spring 102 is mounted between the inner end of the locking lever and a bracket 104 within the housing for urging the lever in a counter-clockwise direction, as viewed in FIG. 3.

In the locked position the connecting pin 82 between link 88 and crank arm 80 lies substantially on a straight line between shaft 76 and lever pin 92. This configuration provides a toggle mechanism which provides a mechanical advantage to multiply the force applied by the crank arm to the locking lever. That is to say, when the crank arm initially pivots upon being struck by the hammer the force applied through pin 82 is substantially at right angles to the axis of link 88 so that a large moment force is applied at the opposite end of the link to lever 94. This force is in turn multiplied by the lever action to insure that the detent is released from engagement with bracket 45 even when a large weight of refuse within the container may be pressing against the lid.

Figure 3:
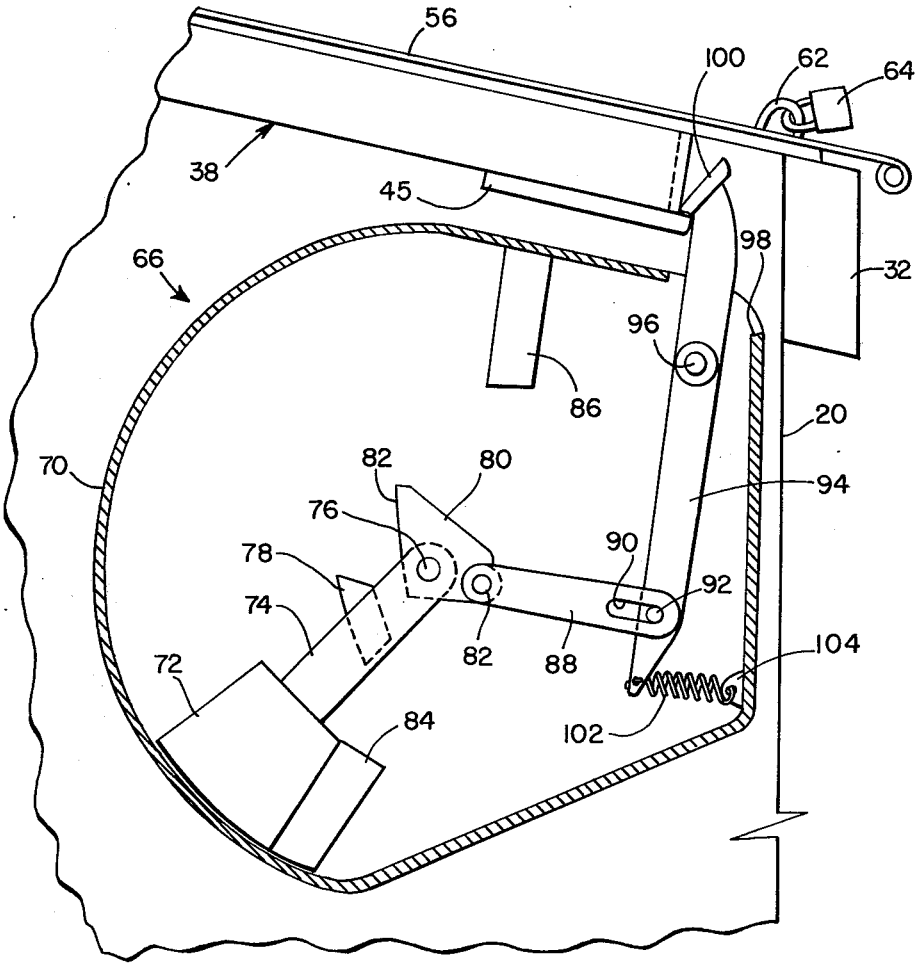
FIG. 3 is a fragmentary section view of the locking mechanism for the container of FIG. 2 shown in the locked position.
Figure 4:
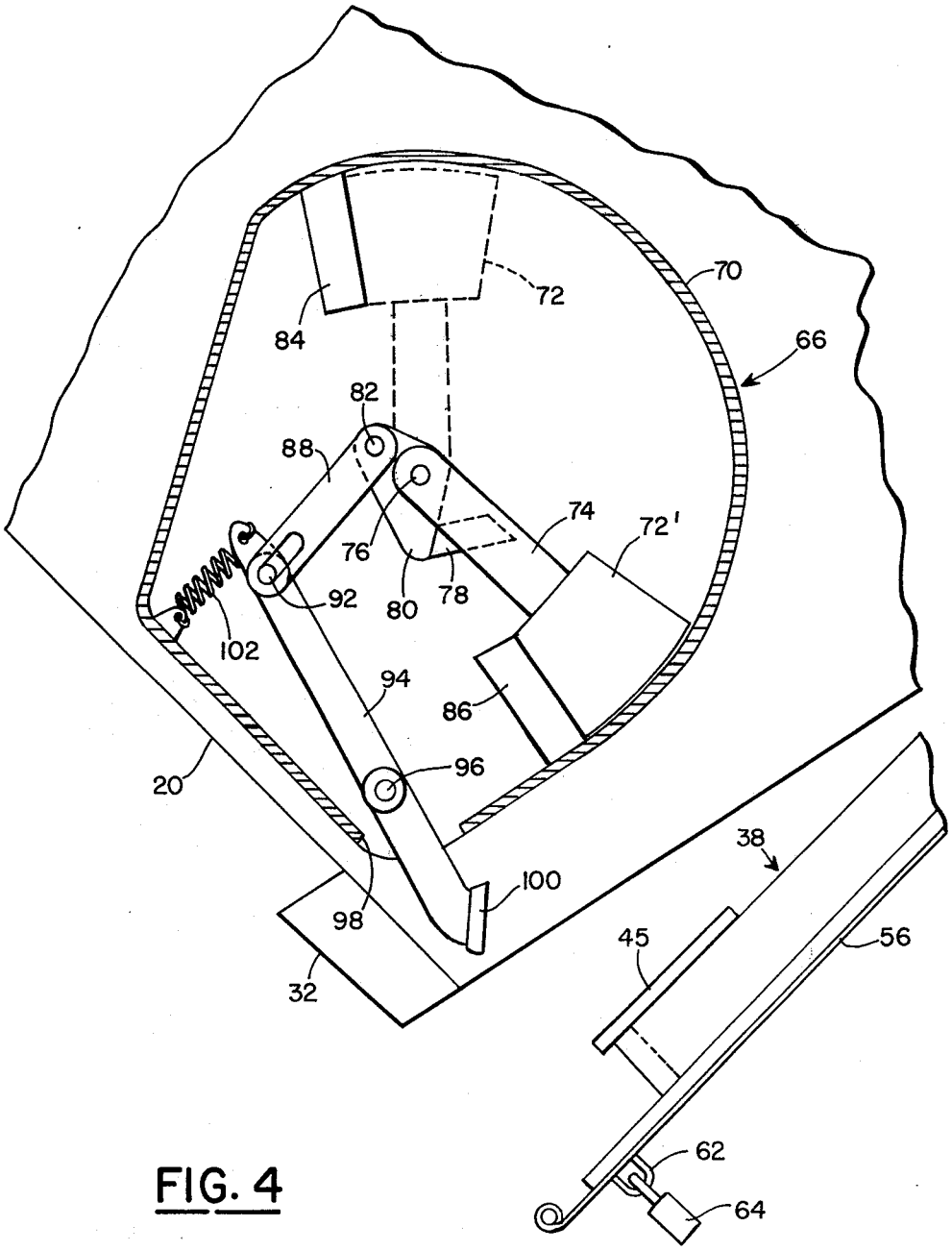
FIG. 4 is a section view similar to FIG. 3 showing the container turned to a position in which the mechanism is unlocked.

In operation, the container is initially in upright position with the elements of both locking mechanisms 66, 68 in the position of FIG. 3 and with the detents engaging closure frame 38. The user can lock and unlock padlock 64 to open lid 56 from the frame for periodically placing refuse into the container. When the container is to be emptied the dump truck is driven forward with the boom arms lowered so that tines 16 are inserted into pockets 34, 36. The boom arms are then elevated to raise the container through the path illustrated in FIG. 1. As the container approaches the position at 10''' the weight 72, because it is past its 12 o'clock position, pivots downwardly by gravity. Hammer 78 carried by the weight then moves through a total arc of 135°. This includes 70° of free fall travel before striking the anvil of crank arm 80. The hammer then moves the crank arm through an arc of 65° which includes 36° of travel for disengagement of detent 100 and 29° of travel for clearance of the detent. The crank arm connection with link 88 acts as a toggle to apply a large moment force to locking lever 94 for causing the latter to sharply turn clockwise against the force of spring 102 and release the detent. Closure frame 38 together with lid 56 then swing open by gravity to dump the refuse. The booms are then lowered to move the container back towards its upright position. As the container moves down the closure frame swings shut against the container. When the container is upright the tines are tilted forward of the vehicle so that limit stop 86 moves the weight back past its 12 o'clock position to permit it to drop by gravity toward limit stop 84. At the same time the hammer is moved away from crank arm 80 which is thereby free to pivot back to the position of FIG. 3 by the action of link 88 as the latter is pulled with locking lever 94 by the return action of spring 102. This returns the detent into locking engagement with the closure frame.

While a pair of locking mechanisms are shown in the preferred embodiment, the invention contemplates that one such mechanism could be provided to operate a plurality of detents mounted on a common shaft and which engage the closure frame at spaced positions.

Figure 5:
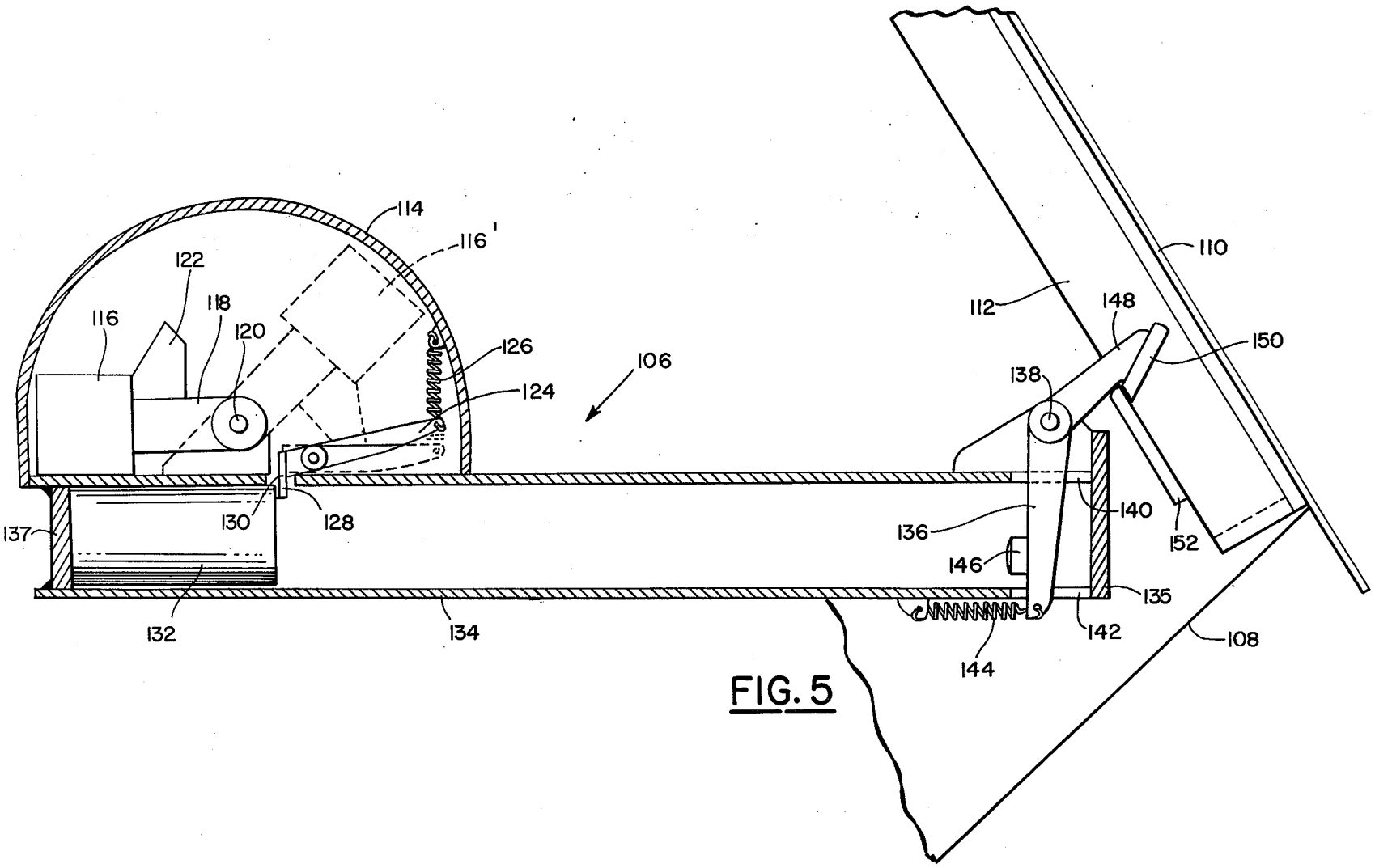
FIG. 5 is a fragmentary view of a container illustrating a locking mechanism incorporating another embodiment of the invention.

FIG. 5 illustrates another embodiment providing a locking mechanism 106 mounted within a refuse container 108 for locking a closure lid 110 and perimeter frame 112. The container, closure and frame are similar in construction and operation to that described for the embodiment of FIGS. 1–4 and thus need not be described in detail. Locking mechanism 106 is mounted within the inner surface of one sidewall. An additional similar locking mechanism, not shown, would preferably be mounted on the opposite sidewall.

Mechanism 106 includes a semi-circular housing 114 in which a weight 116 is mounted on an arm 118 for pivotal movement on shaft 120 through a circular arc. A hammer 122 is mounted on the arm. A detent arm 124 is pivotally mounted within the housing with a portion of the arm positioned in the path of movement of the hammer. A tension spring 126 is connected between one end of arm 124 and the housing for urging the arm in a counter-clockwise direction, as viewed in FIG. 5. A detent 128 mounted on the opposite end of arm 124 projects through an opening 130 formed in the housing.

The lower wall 131 forms a limit stop for the home position of the weight, while detent arm 124 acts as the limit stop for the rest position. The stops are oriented so that the weight travels through an arc of substantially 135° before striking the detent arm.

A second weight 132 of greater mass than weight 116 is mounted within an elongate enclosure or tube 134 which guides the second weight along a linear path. The tube is mounted at an angle on the order of 45° from the horizontal when the container is upright. Weight 132 is retained in the lower end of the tube (illustrated to the left of FIG. 5) by the end of detent 128. The opposite ends of the tube are closed by end plates 135, 137.

The upper end of tube 134 carries a locking lever 136 which is pivotally mounted on a pin 138. The lever projects through diametral openings 140, 142 formed in the tube and a tension spring 144 is connected with the lower end of the lever for pivoting it clockwise as viewed in FIG. 5. An anvil 146 is mounted on the lever in the path of travel of weight 132. Lever 136 includes an arm 148 which projects upwardly and carries an inclined detent plate 150 to releasably lock with bracket 152 on the closure frame.

In operation, the container is filled with refuse when in an upright position by unlocking the padlock and opening closure lid 110 from frame 112 as in the previous embodiment. The container is emptied by being lifted and turned over by the boom arms of a dump truck. FIG. 5 illustrates the position after the container has turned through 45°. When the container is turned to a position at which weight 116 is carried past its 12 o'clock position the latter is pivoted downwardly by gravity until hammer 122 strikes arm 124. The arm is thereby pivoted against the force of spring 126 so that detent 128 is moved out of engagement with second weight 132. At this point 134 is in an upright position so that the second weight is free to fall downwardly. The weight travels a relatively long distance to build up substantial momentum so that a large impact force is delivered to lever 136 when it strikes anvil 146. The lever is pivoted counter-clockwise to disengage detent 150 from closure frame 112 which is thereby free to swing open with lid 110 to dump the contents. As the container is returned by the booms the frame and lid swing back against the container with bracket 152 camming against detent 150 to automatically relock. Weight 132 slides back along the tube as the latter is turned past its horizontal position. Further return movement of the container brings weight 116 past the 12 o'clock position so that it pivots back by gravity to its home position. Hammer 122 is thereby released from detent arm 124 which is pivoted by spring 126 to move detent 128 into locking position with weight 132.

While the foregoing embodiments are at present considered to be preferred it is understood that numerous variations and modifications may be made by those skilled in the art and it is the intent to cover in the appended claims all such variations and modifications as fall within the true spirit and scope of the invention.

What is claimed is:

1. A device for locking a closure on a container of the type which is turned over for dumping its contents, comprising a weight mounted within the container for movement by gravity along a path when the container is turned through an arc, detent means for releasably holding the closure in closed position on the container, and operating means mounted within the container for actuating said detent means to release the closure from the container responsive to movement of said weight along its path when the container is turned.

2. A device as in claim 1 in which said weight is mounted for movement through an arc about a first axis when the container is moved through a path which turns it about an axis substantially parallel with the first axis.

3. A device for locking a closure on a container of the type which is turned over for dumping its contents, comprising a weight mounted within the container for movement by gravity along a path through an arc about a first axis when the container is moved through a path which turns it about an axis substantially parallel with the first axis, a hammer carried for movement with the weight, detent means for releasably holding the closure in closed position on the container, and operating means for actuating said detent means to release the closure from the container responsive to movement of said weight along its path when the container is turned, the operating means including an anvil mounted in the path of movement of the hammer to be struck and moved thereby, and the operating means includes means interconnecting the anvil with the detent means for releasing the closure when the anvil is struck by the hammer.

4. A device as in claim 3 which includes a first arm connected at one end with the weight and pivotally mounted at its other end about said first axis, said anvil includes a radially extending crank arm which is pivotally mounted adjacent the first arm, said detent means includes a locking lever mounted for pivotal movement within the container, said locking lever having one end projecting into releasable engagement with the closure, and a connecting link mounted at one end to the crank arm and at its other end to the locking lever whereby pivotal movement of the crank arm when the anvil is struck by the weight moves the connecting link to thereby pivot the locking lever for releasing the closure.

5. A device as in claim 4 which includes lost-motion connecting means between the link and locking lever for applying a moment force in a direction to pivot the locking lever out of engagement with the closure.

6. A device as in claim 4 in which when the detent means is locked with the closure the link is aligned along an axis which substantially passes through the point of connection between the crank arm and link and point of connection between the link and locking lever whereby the force of the weight striking the anvil is applied by the crank arm at substantially a right angle to the link in the manner of a toggle linkage and such force is multiplied through the link for pivoting the locking lever to release the detent means from the closure.

7. A device for locking a closure on a container of the type which is turned over for dumping its contents, comprising a weight mounted within the container for movement by gravity along a path when the container is turned through an arc, detent means for releasably holding the closure in closed position on the container, operating means for actuating said detent means to release the closure from the container responsive to movement of said weight along its path when the container is turned, the closure means including a perimeter frame pivotally mounted at one end to the container with said detent means releasably engaging another end of the frame, and a closure lid pivotally mounted at one end above the frame with the opposite end of the lid being selectively locked to the frame whereby the lid can be independently opened for placing material into the container.

8. A device for locking a closure on a container of the type which is turned over for dumping its contents, comprising a weight mounted within the container for movement by gravity along a path when the container is turned through an arc, detent means for releasably holding the closure in closed position on the container, operating means for actuating said detent means to release the closure from from the container responsive to movement of said weight along its path when the container is turned, the operating means including a second weight mounted for movement by gravity through a linear path for operating the detent means, and means for releasing said second weight responsive to said movement of the first-mentioned weight along its path.

9. A device as in claim 8 in which the means for releasing the second weight includes a detent arm mounted for pivotal movement into and out of engagement with the second weight, with a portion of the detent arm being positioned in the path of movement of the first weight whereby contact of the first weight with the detent arm pivots the latter out of engagement with the second weight.

10. A device as in claim 8 in which the operating means includes an elongate enclosure for guiding the second weight along its linear path, said enclosure having a predetermined length which builds up substantial kinetic energy in the second weight upon movement to the end of its path for striking and releasing the detent means from the closure.

11. A device as in claim 10 in which the detent means includes a locking lever mounted at an end of the enclosure for pivotal movement into and out of engagement with the closure, and an anvil carried on the locking lever and positioned in the path of travel of the second weight whereby movement of the second weight against the anvil pivots the lever out of engagement with the closure.

12. A dumping refuse container comprising the combination of a container having an upper open end, a perimeter closure frame pivotally mounted across one side of the open end, a closure lid releasably mounted above the frame, means on the container engageable with the tines of a lifting apparatus for lifting the container through an arc whereby the container is turned over about a lateral axis, a lock housing mounted within the container, a weight pivotally mounted within the housing about a lateral axis, said weight being free to move through a distance when the container is turned over, a crank arm pivotally mounted within the housing, hammer means carried by the weight for contacting and pivoting the crank arm upon said movement of the weight, a locking lever pivotally mounted within the housing, link means connecting the locking lever for movement with the crank arm, and detent means on the locking lever for holding the closure frame on the container opening and for releasing the same when the locking lever is moved by the link means upon said movement of the weight when the container is turned over.

* * * * *